US005141703A

United States Patent [19]

Schmid et al.

[11] Patent Number: 5,141,703

[45] Date of Patent: Aug. 25, 1992

[54] PROCESS OF PRODUCING $MG_2SI$-CONTAINING ALLOYS

[75] Inventors: Eberhard E. Schmid, Alzenau; Kersten V. Oldenburg, Felbern; Georg Frommeyer, Erkrath, all of Fed. Rep. of Germany

[73] Assignee: Metallgesellschaft Aktiengesellschaft, Frankfurt am Main, Fed. Rep. of Germany

[21] Appl. No.: 696,655

[22] Filed: May 7, 1991

[30] Foreign Application Priority Data

May 16, 1990 [DE] Fed. Rep. of Germany ..... 4015741

[51] Int. Cl.[5] ..... C22C 23/00

[52] U.S. Cl. ..... 420/402; 420/407; 420/532; 420/544

[58] Field of Search ..... 420/402, 407, 532, 544

[56] References Cited

U.S. PATENT DOCUMENTS

| | | | |
|---|---|---|---|
| 3,119,684 | 1/1964 | Foerster | 420/407 |
| 3,162,511 | 12/1964 | Foerster et al. | 420/407 |
| 3,162,552 | 12/1964 | Foerster | 420/407 |
| 4,675,157 | 6/1987 | Das et al. | 420/407 |

FOREIGN PATENT DOCUMENTS

| | | | |
|---|---|---|---|
| 0492582 | 11/1975 | U.S.S.R. | 420/407 |

*Primary Examiner*—Upendra Roy

*Attorney, Agent, or Firm*—Sprung Horn Kramer & Woods

[57] ABSTRACT

In a fusion-metallurgical process of producing fine-grained hereogeneous, ductile alloys which contain $Mg_2Si$, the grain size of the $Mg_2Si$ crystallites formed by primary solidification is kept below 30 μm by doping the molten alloy with 0.05 to 2% by weight of phosphorus.

10 Claims, No Drawings

PROCESS OF PRODUCING $MG_2SI$-CONTAINING ALLOYS

DESCRIPTION

This invention relates to a fusion-metallurgical process of producing fine-grained, heterogeneous, ductile alloys, which contain $Mg_2Si$ and in which the intermetallic $Mg_2Si$ phase undergoes a primary solidification.

BACKGROUND OF THE INVENTION

Materials which contain intermetallic phases combine metallic and ceramic properties, such as high thermal conductivity, high melting temperature and in some cases satisfactory ductility, and for this reason are apparently adapted for use in the region between conventional metallic high-temperature materials and ceramics, which are strong at high temperatures, but are brittle.

These considerations are of special interest in connection with gas turbines and internal combustion engines, in which the use of improved materials may permit operation at higher temperatures and, as a result, operation with a higher thermal efficiency, and in the design of chemical plants for processes which involve high temperatures and aggressive materials. This is of far-reaching significance because it improves the utilization of energy.

The previous considerations regarding materials which contain intermetallic phases have preferably been concerned with applications such as gas turbine blades for use at temperatures of at least 1100° C. For this reason, mainly compounds having a high melting point have been taken into account, such as TiAl having a melting point of 1460° C. and NiAl having a melting point of 1638° C. However the components of reciprocating internal combustion engines are heated only to much lower temperatures, which presently amount to about 300° C. at the piston head and which, owing to various boundary conditions, cannot be increased as highly as may be desired. On the other hand, a temperature rise by 100° to 200° C. at portions which are under particularly heavy loads would constitute considerable progress. Whereas ceramic materials may be used for that purpose, they will undesirably add to the weight and can be shaped only at a considerable expenditure and can be manufactured only at high cost.

The intermetallic phase alloy $Mg_2Si$ in accordance wtih DE 37 02 721 A has a higher high-temperature strength than conventional light alloy materials and is relatively light in weight and can well be shaped and easily be produced. That alloy has a melting point of 1092° C., a density of 1.95 g/cm$^3$ and a virtually negligible homogeneity.

Because $Mg_2Si$ has a high hardness of VHN 450 at room temperature and VHN 180 at 360° C., a low coefficient of expansion amounting to $7\times10^{-6}K^{-1}$ at room temperature and to $12\times10^{-6}K^{-1}$ at 360° C., and a high resistance to corrosion by hot gas, that material is excellently suited for use in the manufacture of components which are to be subjected to high thermal and mechanical loads in internal combustion engines and particularly for use in the manufacture of components, particularly pistons, for lining the combustion chamber of internal combustion engines. $Mg_2Si$ has a compressive strength of 1600 mPa at room temperature.

To reduce the brittleness of shaped bodies made of $Mg_2Si$ and to improve their ductility, grain refining is desirable, which may be effected by addition of up to 42% by weight aluminum and/or up to 22% by weight silicon.

A preferred composition of the $Mg_2Si$ alloy is represented by a ternary system aluminum-magnesium-silicon in the area which is defined by the eutectic valley, by the quasibinary section, and by 42% by weight. The ductility can also be improved by replacing the silicon by 0.1 to 10% by weight of one or more of the elements germanium, tin, lead or by elements having similar physical-chemical properties.

A fine-grained structure can be achieved by addition of crystallization-promoting agents, such as boron, titanium, lithium, zirconium, hafnium, vanadium, niobium, tantalum, chromium, molybdenum and tungsten, individually or in combination.

The hardness of $Mg_2Si$ can be increased by addition of nickel, copper and/or cerium.

In the production of $Mg_2Si$ alloys by fusion metallurgy, conventional crucible materials and an inert atmosphere are employed and the molten material is superheated by 20° to 50° C. The material for the permanent molds may particularly consist of iron or copper.

The $Mg_2Si$ alloys thus produced have a dendritic solidification structure consisting of $Mg_2Si$ crystallites having an average grain diameter not in excess of about 200 μm. Besides, heterogeneous $Mg_2Si$ alloys in combination with light metals, such as aluminum and magnesium, contain said crystallites in a distinctly inhomogeneous distribution in the aluminum or magnesium matrix. Owing to the high solubility of gases, particularly hydrogen, in the components of such alloys, the hypereutectic concentrations cannot easily be achieved. Besides, such $Mg_2Si$ alloys in spite of cooling at a high rate in excess of $10^4K\times s^{-1}$ will have an excessively high gas porosity if they contain more than 30 mole percent $Mg_2Si$.

SUMMARY OF THE INVENTION

It is an object of the present invention so to produce $Mg_2Si$-containing alloys by fusion metallurgy that formation of a dendritic structure by the $Mg_2Si$ crystallites will be suppressed and that the maximum grain size of the $Mg_2Si$ crystallites will be decreased to values below 30 μm.

That object is accomplished in that the molten alloy which contains $Mg_2Si$ is doped with 0.05 to 2% by weight of phosphorus. The solidification of the molten alloy will be accompanied by formation of minute seed crystals, which contain phosphorus and on which primary solidification of $Mg_2Si$ crystals will take place so that the maximum grain size of the $Mg_2Si$ crystallites will be decreased and will not be in excess of 30 μm and will preferably amount to 13 to 15 μm. This may result in a grain refining by the formation of heterogeneous, seed-forming phosphides, which are contained in a state of fine dispersion in the molten alloy and on which $Mg_2Si$ crystallites crystallize as a result of a peritectic reaction during the solidification so that a grain refining is additionally effected.

DETAILED DESCRIPTION OF THE INVENTION

The doping of the molten alloy which contains $Mg_2Si$ with 0.15 to 0.3% by weight of phosphorus results in an optimum grain refining of the $Mg_2Si$ crystallites in the structure of the alloy. If the phosphorus content is less than 0.15% by weight, the grain-refining action of the phosphorus will begin slightly to decrease so that the solidification of the alloy will be accompanied by an increase of the average maximum grain size of the $Mg_2Si$ crystallites and, as a result, their dendritic solidification structure will increase. No grain-refining action can be observed in case of doping with less than 0.05% by weight phophorus.

In order to prevent an evaporation of phosphorus, which has a high vapor pressure, from the molten $Mg_2Si$ alloy, it is recommendable to introduce the phosphorus in encapsulated form into the molten alloy.

According to a further feature of the process in accordance with the invention, molten alloys which contain more than 30 mole percent of $Mg_2Si$ are doped with between 0.3 and 2% by weight of phosphorus in order to decrease the gas porosity of the alloy structure.

The phosphorus may be replaced entirely or in part by phosphorus-containing master alloys which have a eutectic composition, such as CuP or the like, or by phosphorus-containing salts, such as phosphides, phosphites, phosphates or the like. For improved age hardening, a further feature of the invention may be adopted, which resides in that up to 5% by weight of copper is alloyed to the molten alloy which contains $Mg_2Si$.

Heating to elevated temperatures or superheating of the molten alloy which contains $Mg_2Si$ will result in evaporation of the phosphide which has been formed by reaction between the dissolved hydrogen and phosphorus and the hydrogen content of the molten alloy will thus be decreased. That evaporation must be controlled to prevent depletion of the molten alloy below the phosphorus concentration which is requried for the grain-refining effect.

The age hardening of the $Mg_2Si$ alloy which is produced may be improved by doping the molten alloy with up to 5.0% by weight of copper. A copper content in excess of 5% by weight will result in embrittling and in decrease of the resistance to corrosion and temperature stability.

In a preferred composition the molten alloy which contains $Mg_2Si$ contains additions of 1 to 85% by weight of aluminum and/or 2 to 58% by weight of silicon.

For a manufacture of shaped bodies from the molten alloy which contains $Mg_2Si$, the components of the alloy are melted in a crucible consisting of conventional materials, such as carbon or alumina-graphite, the molten alloy is superheated by 20° to 50° C. in order to improve the agitation and the pourability, and is poured, preferably in an inert gas stream, into water-cooled permanent molds made of conventional mate materials, scuh as copper or iron.

42% by weight aluminum, 1% by weight phosphorus in encapsulated form and 22% by weight silicon are consecutively added to molten magnesium and the molten alloy is heated to 874° C., i.e., 50% above its liquidus temperature in an alumina-graphite crucible. For the manufacture of pistons for internal combustion engines, the molten alloy is poured in an inert gas stream into permanent molds.

It will be understood that the specification and examples are illustrative but not limitative of the present invention and that other embodiments within the spirit and scope of the invention will suggest themselves to those skilled in the art.

What is claimed is:

1. In the fusion-metallurgical production of a fine-grained, heterogeneous, ductile alloy, which essentially consists of $Mg_2Si$ and in which the intermetallic $Mg_2Si$ phase undergoes primary solidification, the improvement which comprises melting the alloy and doping the molten alloy with about 0.05 to 2% its weight of phosphorus in the form of phosphorus, a phosphorus-containing master alloy which has a eutectic composition, a phosphorus-containing salt or mixtures thereof.

2. A process according to claim 1, wherein the molten alloy is doped with about 0.15 to 0.3% its weight of phosphorus.

3. A process according to claim 1, wherein the molten alloy contains more than 30 mole percent $Mg_2Si$ and is doped with about 0.3 to 2% by weight of phosphorus.

4. A process according to claim 1, wherein the phosphorus is added to the molten alloy in capsulated form.

5. A process according to claim 1, wherein the doping material comprises a phosphorus-containing master alloy which has a eutectic composition.

6. A process according to claim 1, wherein the doping material comprises CuP.

7. A process according to claim 1, wherein the doping material comprises a phosphorus-containing salt.

8. A process according to claim 1, wherein the doping material comprises at least one of a phosphide, phosphite and phosphate.

9. A process according to claim 1, wherein the molten alloy is additionally doped with up to 5% by weight of copper.

10. A process according to claim 1, wherein to the molten alloy there is added at least one of 0.5 to 85% by weight of aluminum and 2 to 58% by weight of silicon, based on the weight of the molten alloy.

* * * * *